United States Patent [19]

Gay

[11] Patent Number: 4,763,735

[45] Date of Patent: Aug. 16, 1988

[54] MOBILE MACHINE FOR MAKING HOLES IN PUTTING GREENS

[76] Inventor: Ernest Gay, 1204 Sparta St., McMinnville, Tenn. 37110

[21] Appl. No.: 98,311

[22] Filed: Sep. 18, 1987

[51] Int. Cl.[4] ..... A01B 45/00; E21B 19/08; E21B 12/06

[52] U.S. Cl. ..... 175/161; 175/203; 175/313; 172/21; 172/22

[58] Field of Search ..... 175/20, 27, 44, 51, 175/313, 161, 162, 203, 220, 403; 172/15, 21, 22, 111

[56] References Cited

U.S. PATENT DOCUMENTS

| | | | |
|---|---|---|---|
| 2,881,844 | 4/1959 | Miller | 172/22 |
| 3,152,653 | 10/1964 | Sievers | 175/161 |
| 3,224,512 | 12/1965 | Alexander | 175/20 |
| 3,817,337 | 6/1974 | Panak et al. | 172/22 X |
| 4,585,072 | 4/1986 | Martinez | 172/22 |

FOREIGN PATENT DOCUMENTS

| | | | |
|---|---|---|---|
| 2031484 | 4/1980 | United Kingdom | 175/313 |

*Primary Examiner*—Stephen J. Novosad
*Assistant Examiner*—Bruce M. Kisliuk
*Attorney, Agent, or Firm*—William D. Stokes

[57] ABSTRACT

A mobile machine for making holes in putting greens including a frame connected to a vehicle such as a mower, a cutter assembly mounted on a carriage slidably mounted on the frame for moving the cutter assembly in a vertical plane relative to the ground. The cutter assembly is freely pivoted to the carriage about orthogonal axes and a releasable lock mechanism is provided to hold the cutter assembly in a vertical orientation. A motor is mounted on the carriage for rotating the cutter, and the cutter assembly is detachably connected to the motor drive shaft so that the plug cut from the hole can be manually ejected into a previously formed hole where the cup has been removed. A depth gauge is provided between the frame and carriage indicating the depth of the cutter in the ground, and the carriage, lock mechanism and motor are hydraulically driven through a hydraulic circuit connected to the mower.

13 Claims, 5 Drawing Sheets

FIG.1
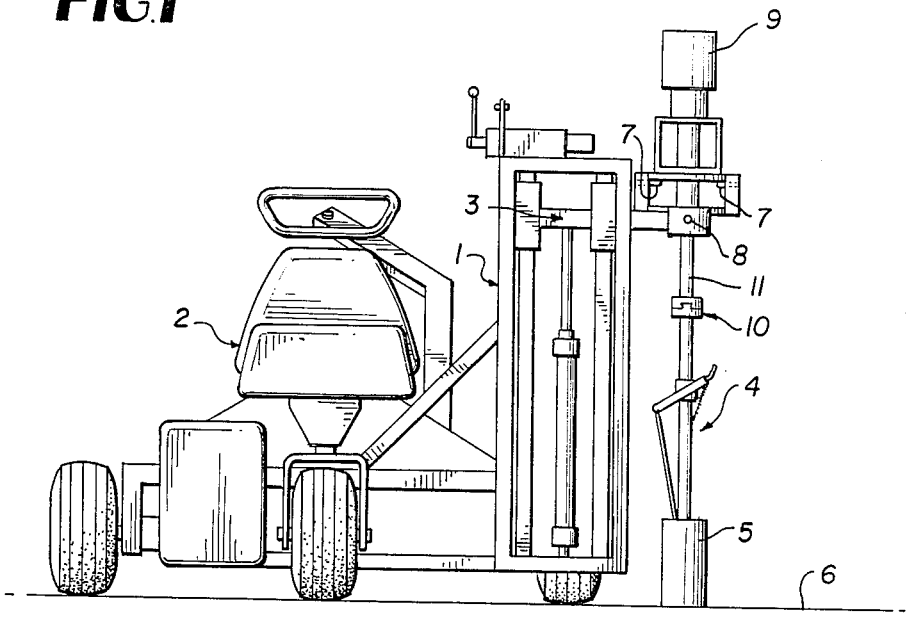
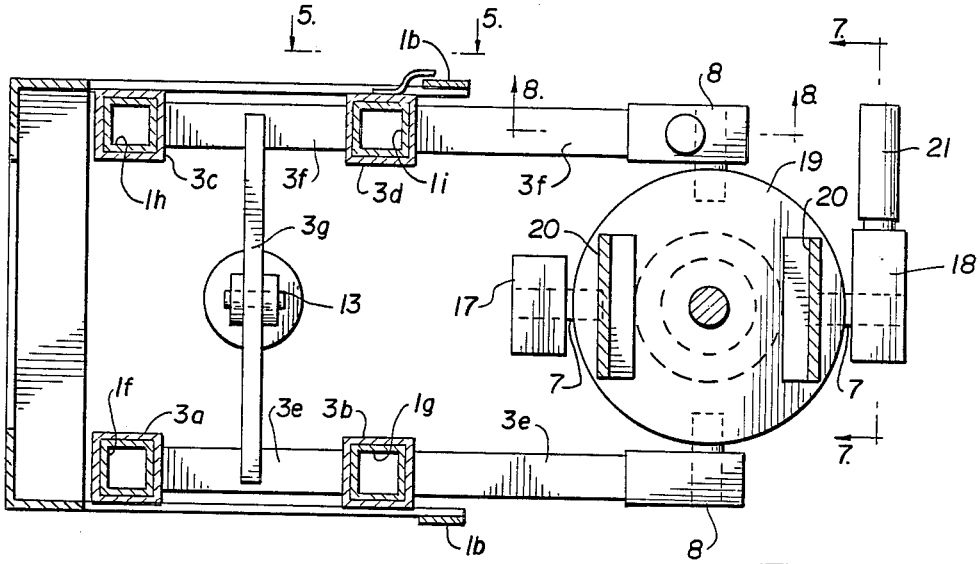
FIG.3
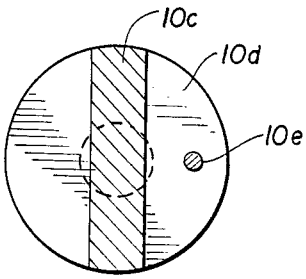
FIG.4

FIG. 5
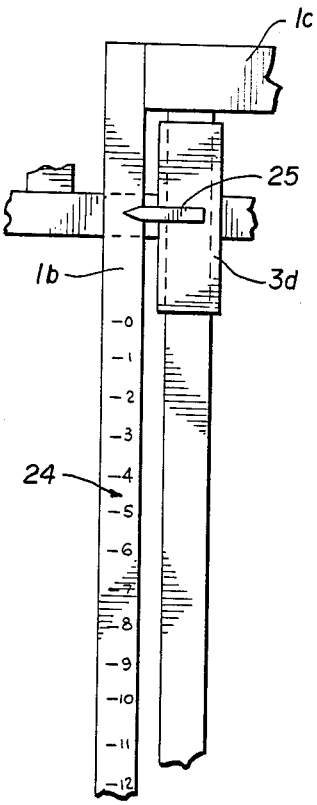
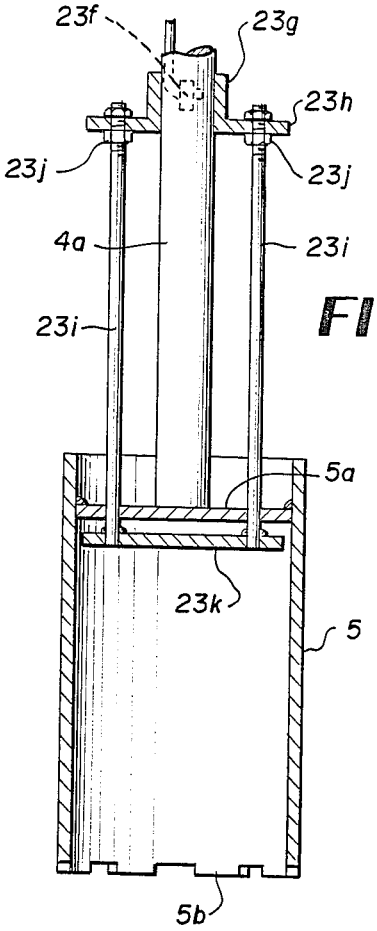
FIG. 6
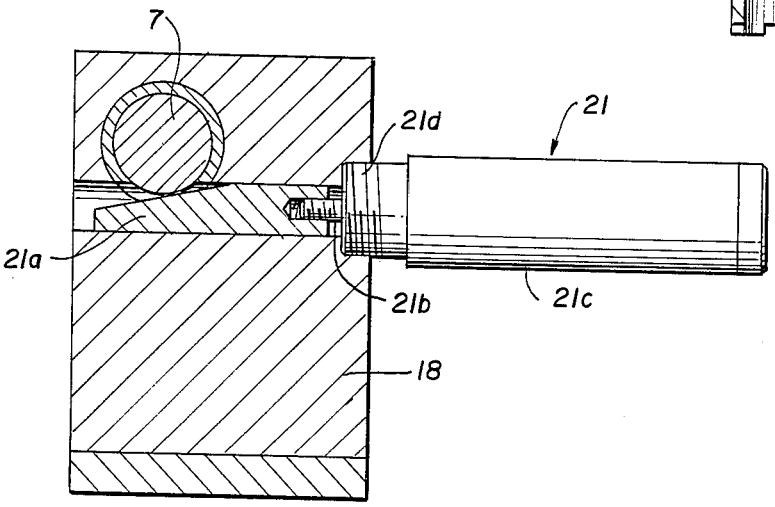
FIG. 7
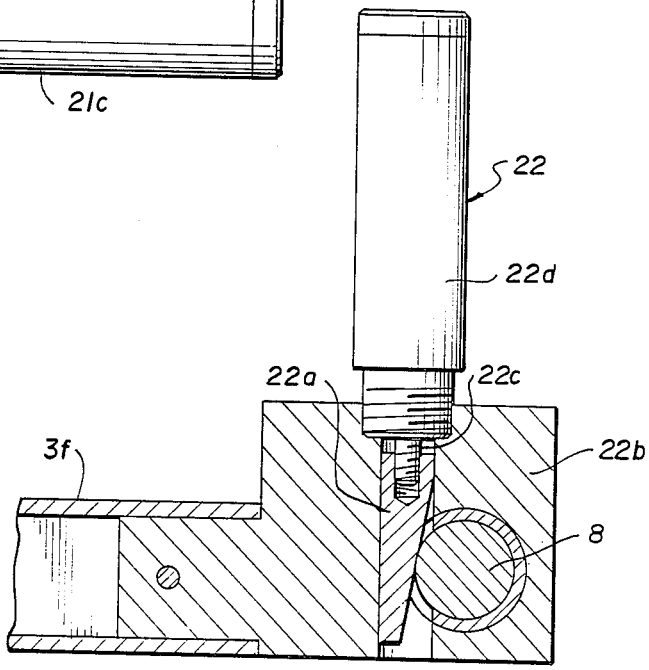
FIG. 8

MOBILE MACHINE FOR MAKING HOLES IN PUTTING GREENS

BACKGROUND OF THE INVENTION

The broad concept of hydraulically actuated machines for making holes in putting greens is disclosed in U.S. Pat. No. 3,817,337 to Panak et al., wherein a wheeled vehicle, such as a greens mower, is provided with a hydraulically actuated cutting cylinder which is forced downwardly into the soil below the turf and then moved upwardly to form a hole in the ground, the soil plug then being ejected from the cutting cylinder.

While the known machines have been satisfactory for their intended purpose, they are characterized by certain disadvantages, most notably, in not being able to orient the cutter assembly in a vertical plane on the green regardless of its slope for digging a straight hole. Furthermore, the construction and arrangement of the ejection mechanism for removing the cut plug from the cutting cylinder did not facilitate the direct ejection of the plug from the cutting cylinder into the previously formed hole where the cup has been removed.

After considerable research and experimentation, the machine for making holes in putting greens has been devised which comprises, essentially, a frame connected to a wheeled vehicle, such as a greens mower. A carriage is slidably mounted on the frame, and a cutter assembly, including a cutting cylinder, is mounted on the carriage whereby the cutting assembly is movable in a vertical plane relative to the ground. The cutter assembly is freely pivoted to the carriage about orthogonal axes, whereby the cutter assembly can freely seek a vertical orientation regardless of the green slope. A releasable lock mechanism is operatively connected to the orthogonal axes to hold the cutter assembly in the vertical orientation, whereby a straight hole can be dug. A motor is mounted on the carriage for rotating the cutter assembly, and the cutter assembly is detachably connected to the motor drive shaft so that the cutting cylinder and associated soil plug can be manually moved to a previously formed hole and the plug ejected from the cutting cylinder into the hole. A depth gauge is provided between the frame and carriage indicating the depth of the cutter in the ground, and the carriage, lock mechanism and motor for rotating the cutter assembly are hydraulically driven through a hydraulic circuit connected to the mower.

BRIEF DESCRIPTION OF THE DRAWINGS

FIG. 1 is a diagrammatic end view showing the machine of the present invention mounted on a mower;

FIG. 3 is a view taken along line 3—3 of FIG. 2;

FIG. 5 is a view taken along line 5—5 of FIG. 3;

FIG. 6 is a view taken along line 6—6 of FIG. 2;

FIG. 7 is a view taken along line 7—7 of FIG. 3;

FIG. 8 is a view taken along line 8—8 of FIG. 3;

FIG. 14 is a schematic view of the hydraulic circuit employed in the machine of the present invention.

DESCRIPTION OF THE PREFERRED EMBODIMENT

Figure 2:
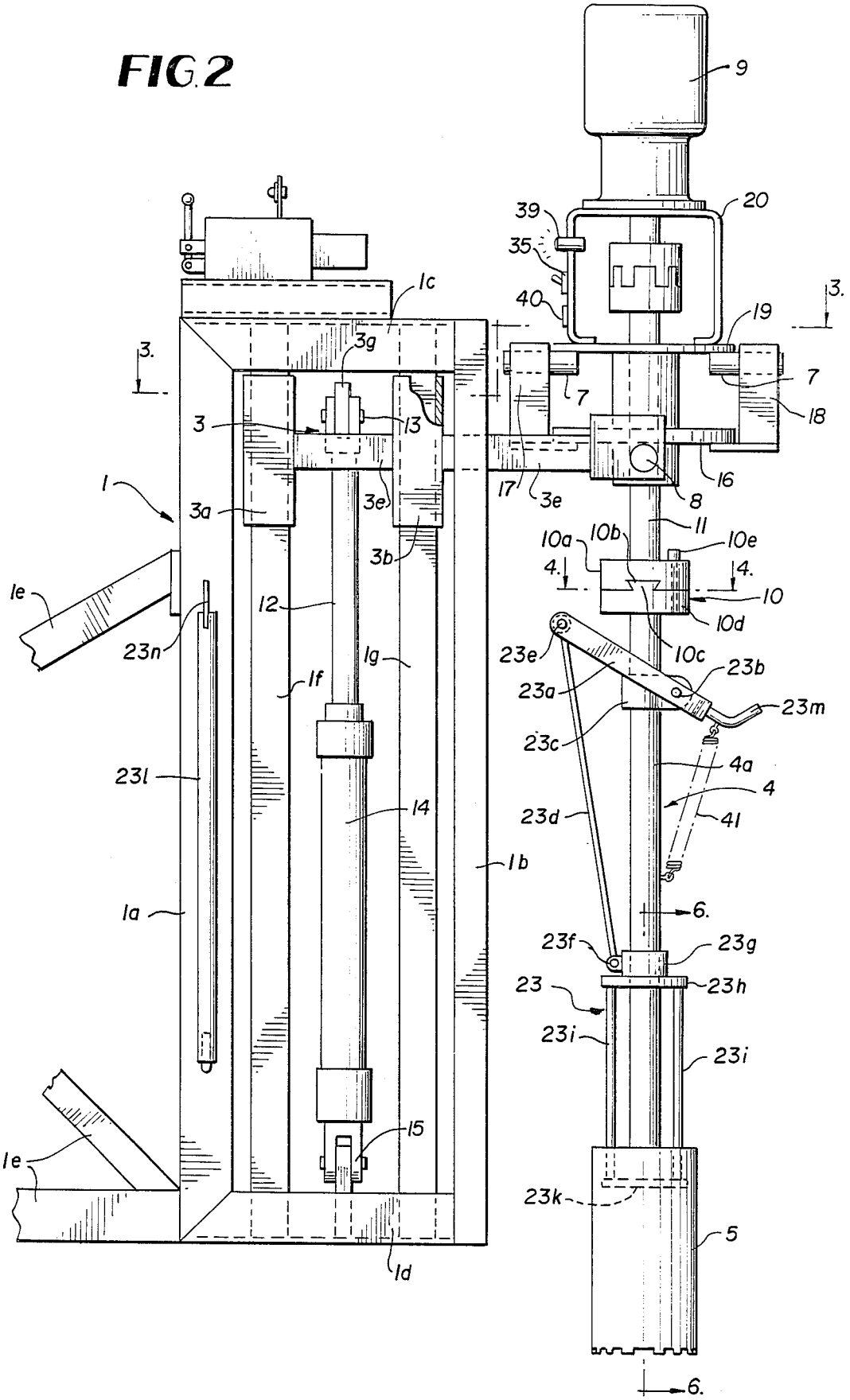
FIG. 2 is an enlarged, elevational end view of the machine.

Referring to the drawings and more particularly to FIG. 1, the machine of the present invention for making holes in putting greens comprises a frame 1 connected to a wheeled vehicle, such as a greens mower 2. A carriage 3 is slidably mounted on the frame, and a cutter assembly 4 including a cutting cylinder 5 is mounted on the carriage 3, whereby the cutting assembly is movable in a vertical plane relative to the ground 6. The cutter assembly 4 is freely pivoted to the carriage 3 about orthogonal axes 7 and 8, and a locking mechanism, to be described more fully hereinafter, is operatively connected to the orthogonal axes 7 and 8 for holding the cutter assembly 4 in a vertical orientation. A motor 9 is mounted on the carriage 3 for rotating the cutting cylinder 5, and a detachable coupling 10 is provided between the motor drive shaft 11 and the cutter assembly 4.

The details of the construction of the machine are shown in FIGS. 2 and 3, wherein it will be seen that the frame 1 comprises a skeletal rectangular frame assembly including vertically extending side frame members 1*a*, 1*b* interconnected at each end by top and bottom angle irons 1*c*, 1*d*. A truss-like frame 1*e* is connected to the frame members 1*a* for rigidly connecting the machine to the mower 2. Mounted within the rectangular frame assembly are four vertically extending tubular columns 1*f*, 1*g*, 1*h*, 1*i* rigidly connected at opposite ends to the angle irons 1*c*, 1*d*.

The carriage 3 comprises four tubular sleeves 3*a*, 3*b*, 3*c*, 3*d* slidably mounted on the tubular columns 1*f*, 1*g*, 1*h*, 1*i*, respectively. The sleeves 3*a* and 3*b* are interconnected by a frame 3*e*, and the sleeves 3*c* and 3*d* are interconnected by a frame 3*f*. A cross-head 3*g* extends between the frames 3*e* and 3*f* to which one end of a piston rod 12 is connected as at 13. The piston rod is telescopically mounted in a hydraulic cylinder 14 connected to the lower end of the frame assembly as at 15. To complete the structure of the carriage, the frame members 3*e* and 3*f* extend outwardly from the frame assembly and provide bifurcated arms for supporting the cutter assembly 4 in a cantilevered manner relative to the frame assembly.

The outer ends of the frame members 3*e* and 3*f* support the pivot pins 8 forming one of the orthogonal axis, and a swivel plate 16 is connected to the pins 8. A pair of brackets 17 and 18 are connected to the swivel plate 16 and carry the pivot pins 7 forming the other orthogonal axis, and a second swivel plate 19 is connected to the pins 7. By this construction and arrangement, the swivel plate 16 and brackets 18 can pivot about pins 8 along a first axis, and the swivel plate 19 can pivot with pins 7 about another axis perpendicular to the first axis. A mount 20 is fixedly attached to the swivel plate 19 upon which the motor 9 is supported. The motor drive shaft 11 extends downwardly through the swivel plates 16 and 19 and is provided at its lower end with the detachable coupling 10 which carries the cutter assembly 4.

It will be readily seen that due to the construction of the machine thus far described, the cutter assembly 4 is freely pivotal about the orthogonal axes provided by pins 7 and 8 and because the weight of the cutter assembly 4 is greater than the weight of the motor 9, the depending cutter assembly will become oriented in a vertical position. In order to hold the cutter assembly 4 in the vertical position, the pivot axes 7 and 8 are each provided with a locking mechanism 21 and 22, as shown in FIGS. 3, 7 and 8. The locking mechanism 21 comprises a wedge member 21*a* slidably mounted in the bracket 18 and adapted to frictionally engage the pivot pin 7, the wedge member 21*a* being connected to a plunger 21*b* which forms the piston rod of a hydraulic cylinder 21*c*, threadably connected to the bracket 18 as at 21*d*. Similarly, locking mechanism 22 comprises a wedge member 22*a* slidably mounted in a block or housing 22*b* connected to the end of tubular frame member 3*f*, and through which the pivot pin 8 extends, the wedge member 22*a* being connected to a plunger 22*c* of the hydraulic cylinder 22*d*.

Figure 4:
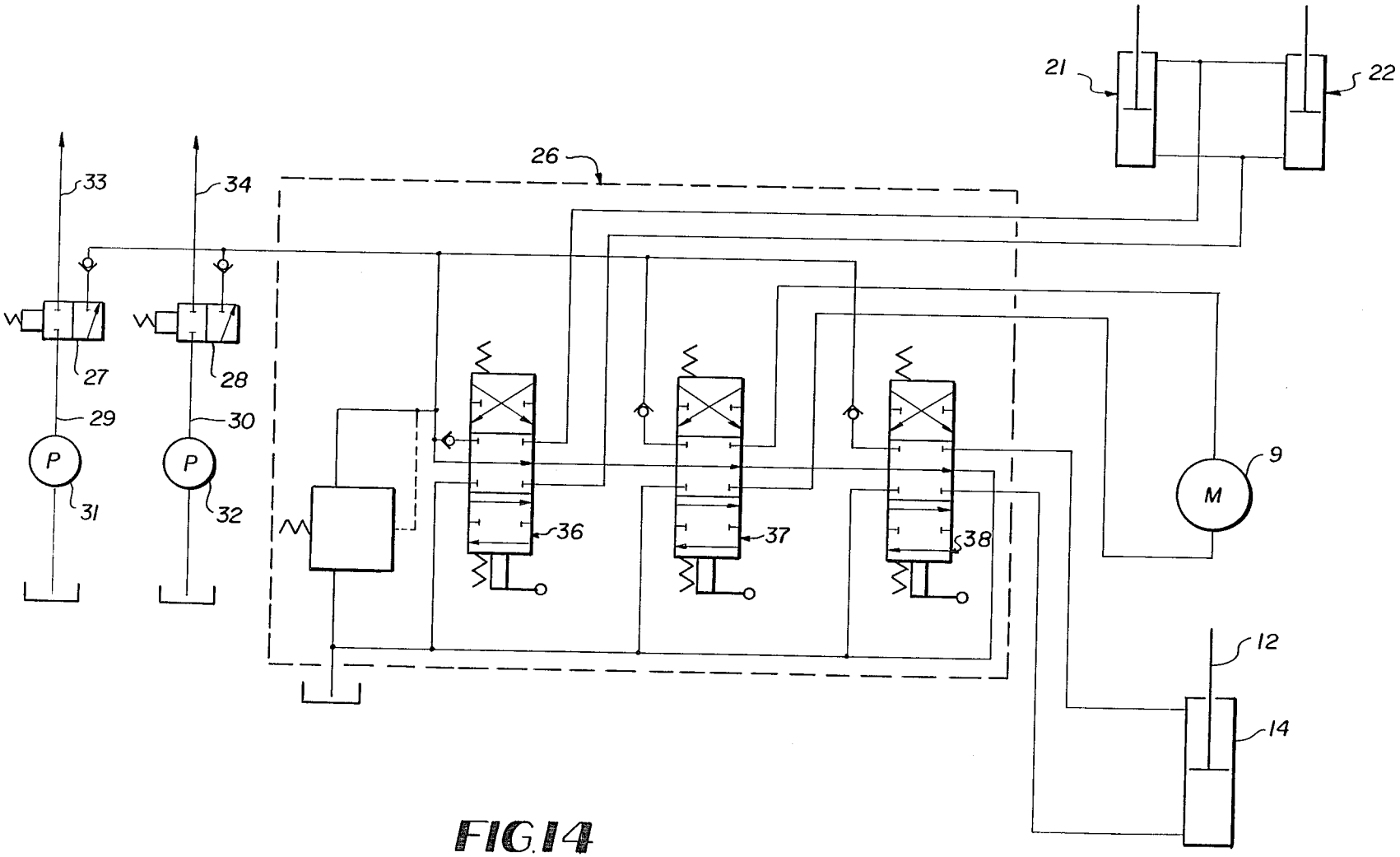
FIG. 4 is a view taken along line 4—4 of FIG. 2.

As will be seen in FIGS. 2 and 4, the cutter assembly 4 is detachably connected to the end of the motor drive shaft by the detachable coupling 10 comprising a disc flange 10*a* connected to the end of the motor drive shaft 11 and having a dovetail slot 10*b* formed in the face thereof for slidably receiving a correspondingly configured key 10*c* formed on the opposing face of a disc flange 10*d* connected to the upper end of a rod 4*a* having the cutter cylinder 5 connected to the lower end thereof. An axially extending pin 10*e* extends between the disc flanges 10*a* and 10*d* for holding the coupling in the operative position.

Referring to FIGS. 2 and 6, it will be seen that the cutter assembly 4 comprises the rod 4*a* having the lower end thereof connected to an end wall 5*a* of the cutting cylinder 5 having soil penetrating teeth 5*b* formed on the lower peripheral edge thereof.

As will be seen in FIGS. 2 and 6, the cutter assembly 4 and associated cutting cylinder 5 is provided with a soil plug ejecting mechanism 23 which comprises a lever 23*a* pivotally connected as at 23*b* to a collar 23*c* fixedly attached to the rod 4*a*. A connecting rod 23*d* is provided having one end connected to the end of the lever 23*a* as at 23*e* and the opposite end connected as at 23*f* to a collar 23*g* slidably mounted on the rod 4*a*. The collar 23*g* includes a flange portion 23*h* to which the upper ends of a pair of tie rods 23*i* are fastened as at 23*j*. The lower ends of the tie rods 23*i* extend through the cutting cylinder end wall 5*a* have a disc plate 23*k* rigidly connected thereto.

From the above description of the cutter assembly 4, it will be readily apparent that rotation of the lever 23*a* in a counterclockwise direction will cause the connecting rod 23*d* to push the collar 23*g* and associated disc plate 23*k* downwardly toward the open end of the cutting cylinder 5. To facilitate the rotation of lever 23*a*, a tubular handle 23*l* (FIG. 12) is provided which may be stored on the vertically extending side frame member 1*a*, the end of the lever 23*a* having an extension 23*m* for receiving an end of the tubular handle 23*l*, the opposite end of the handle having a hook 23*n*. In the preferred embodiment, spring means 41 provided for connecting lever 23*a* (in the drawing shown connected to extension 23*m* of lever 23*a*) and rod 4*a* to maintain the plug ejector element in the raised position.

To complete the structural description of the cutter assembly, as will be in FIGS. 3 and 5, a depth gauge for the cutter assembly is provided which comprises a suitable depth scale 24 provided on the vertically extending side frame member 1*b* and a cooperating pointer 25 connected to the tubular sleeve 3*d*, whereby upon contraction of the piston rod 12 into the cylinder 14, to thereby pull the carriage downwardly, the pointer 25 will indicate the depth of penetration of the cutting cylinder 5, as indicated on the scale 24.

Figure 13:
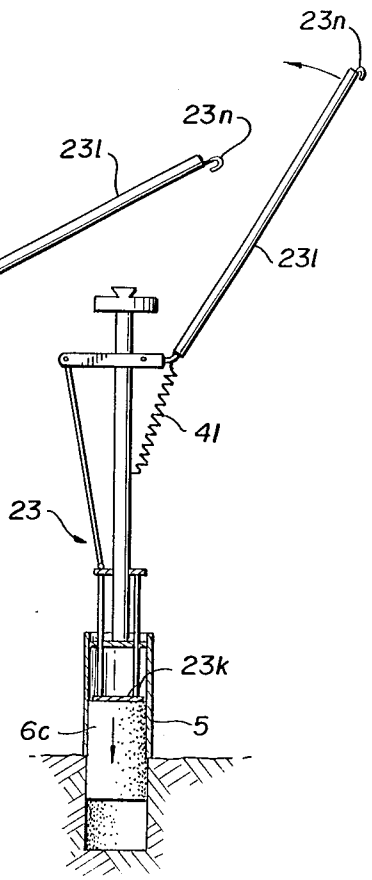
FIGS. 12 and 13 are diagrammatic views illustrating the use of the cutter assembly when plugging the old hole.
Figure 12:
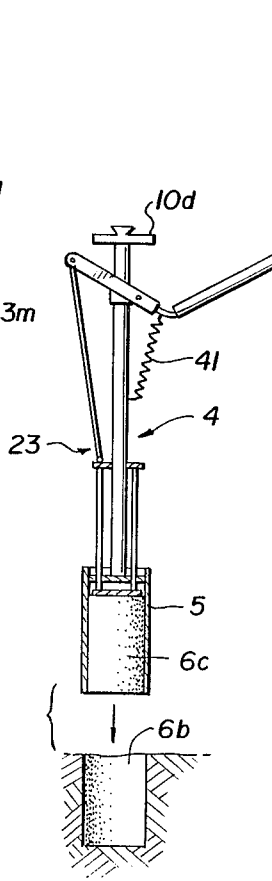
Figure 11:
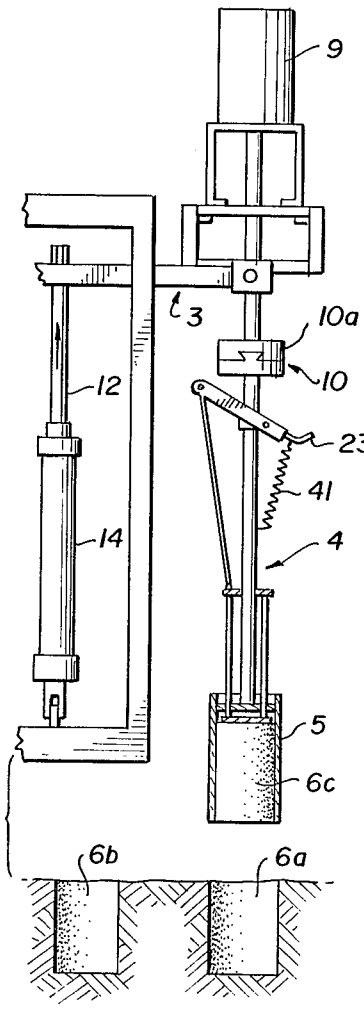
FIGS. 9, 10 and 11 are diagrammatic views illustrating the use of the machine when digging a new hole.
Figure 10:
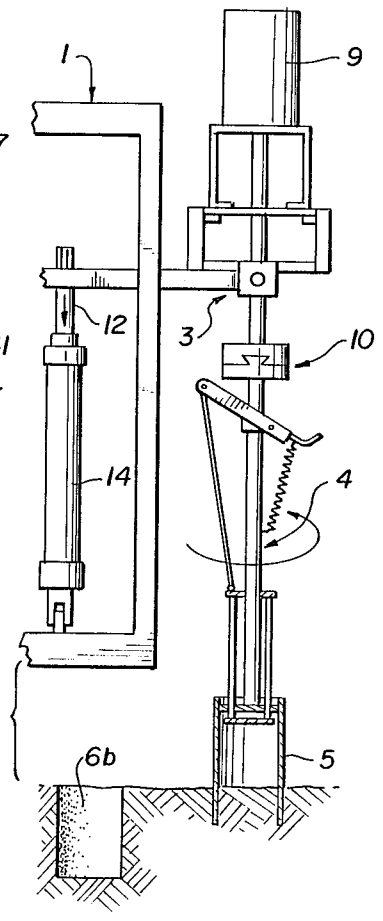
Figure 9:
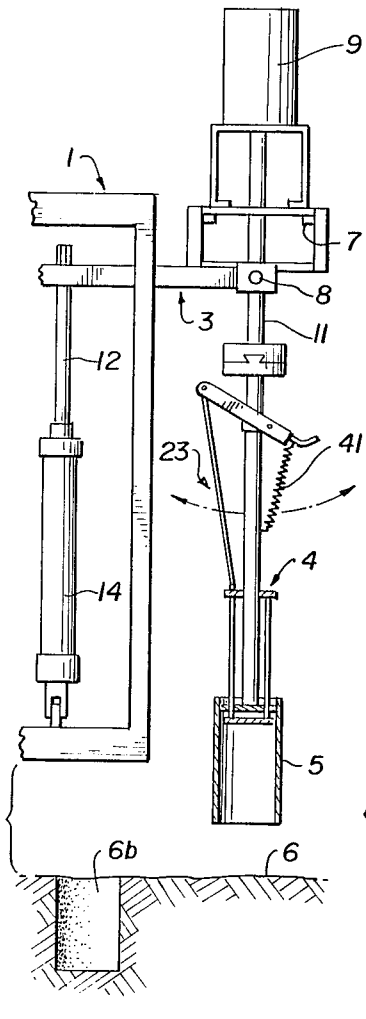

The operation of the machine of the present invention is illustrated in FIGS. 9 to 13 wherein it will be seen the operator positions the cutter assembly 4 over the ground 6 where it is desired to cut the new hole. The cutter assembly is allowed to freely pivot about the axes 7 and 8, as shown in FIG. 9, until a static vertical orientation is reached, at which time the locking mechanisms 21 and 22 are activated, whereby the cutter assembly 4 is held in the vertical position. The piston rod 12 is retracted into the cylinder 14, as shown in FIG. 10, to thereby cause the carriage 3 and associated cutter assembly 4 to move in a direction toward the ground. While the cutter assembly is moving toward the ground, the motor 9 is actuated to cause rotation of the cutting cylinder 5 into the ground. Once the cutting cylinder 5 has reached the desired depth, the motor 9 is de-energized and the piston rod 12 is extended, as shown in FIG. 11, to thereby lift the cutting cylinder 5 out of the newly-formed hole 6*a*. The coupling 10 is then disconnected so that the operator can manually carry the cutter assembly 4 to the previously formed hole 6*b*, as shown in FIG. 12, and eject the plug of turf and soil 6*c* into the hole 6*b* by operating the plug ejecting mechanism 23, as shown in FIG. 13, and described hereinabove.

Referring to FIG. 14, the motor 9, piston rod 12 and locking mechanisms 21, 22 are hydraulically actuated through a hydraulic circuit 26 connected to the hydraulic drive system of the mower. To this end, a pair of electrically activated diverter valves 27, 28 are interposed the respective supply lines 29, 30 from the pumps 31, 32 and the lines 33, 34 to the mower reels and drive wheels. A toggle switch 35 (FIG. 2) is mounted on the motor mount bracket 20 for simultaneously actuating the diverter valves 27, 28, whereby the supply of hydraulic fluid is diverted from the mower reels and wheels to the hydraulic circuit 26.

The hydraulic circuit 26 includes manually operated selector valves 36, 37 and 38 for controlling the actuation of the locking mechanisms 21, 22, the hydraulic motor 9, and the piston rod 12, respectively. The selector valves 36, 37 and 38 are mounted on the top of the frame 1 in a position accessible to the operator as shown in FIG. 2.

Also mounted on the motor mounting bracket 20 in view of the operator is a light 39 connected with a mercury switch 40 in an electrical circuit, whereby when the cutter assembly 4 is in a vertical position, the light 39 becomes illuminated.

In use, the operator drives the mower to a position where it is desired to dig a new hole in the putting green. The toggle switch 35 is then actuated to energize the diverter valves 27 and 28, whereby the mower's source of hydraulic fluid is diverted to the hydraulic circuit 26. When the cutter assembly 4 becomes oriented in a vertical position, the light 39 becomes illuminated. This is observed by the operator who then actuates selector valve 36 to energize the locking mechanisms 21, 22, to thereby lock the cutting mechanism 4 in the vertical position. Selector valve 37 is then actuated, whereby motor 9 is driven to rotate the cutter assembly. Selector valve 38 is then actuated to retract the piston rod 12 into the cylinder 14 to thereby lower the cutting cylinder 5 into the ground. As the cutting cylinder penetrates the soil, the operator watches the depth gauge 24, and when the proper depth is obtained, selector valve 37 is actuated to stop motor 9, and selector valve 38 is actuated to extend the piston rod 12, to thereby lift the cutter assembly 4 upwardly with the cutting cylinder 5 containing the plug 6c of turf and soil. Toggle switch 35 is then actuated to de-activate diverter valves 27 and 28, whereby the hydraulic fluid is directed to the power train of the mower so that it can be driven off of the green. The operator then removes the cutter assembly 4 and ejects the plug 6c into the hole 6a, as described hereinabove in connection with FIGS. 12 and 13; however, before inserting the plug 6c into the previously-formed hole 6b, the operator takes the handle 23e and, using the hook 23n on one end thereof, removes the cup (not shown) from the hole 6b which is then placed into the new hole 6a. The cutter assembly 4 is then connected to the coupling 10, and the operator proceeds to mow the green.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A mobile machine for making holes in putting greens comprising, a motor driven vehicle, a frame assembly connected to said vehicle, carriage means slidably mounted on said frame assembly, power means mounted between said frame assembly and said carriage means for moving the carriage means in a vertical plane relative to the ground, cutter means mounted on said carriage means and depending therefrom, pivot means connecting said cutter means to said carriage means, whereby the cutter means is freely pivoted to the carriage means about orthogonal axis, and releasable lock means operatively connected to said pivot means for holding said cutter means in a vertical orientation.

2. A mobile machine according to claim 1, wherein the carriage means comprises, a plurality of vertically extending tubular columns mounted in said frame assembly, a sleeve slidably mounted on each tubular column, and frame members connected to said sleeves providing a bifurcated arm for supporting the cutter means in a cantilevered manner relative to the frame assembly.

3. A mobile machine according to claim 2, wherein said cutter means comprises a pair of parallel, vertically spaced swivel plates, bracket means for supporting the upper swivel plate on the lower swivel plate, motor means mounted on the upper swivel plate, a drive shaft extending downwardly from said motor means, a cutting cylinder connected to said drive shaft at the lower end thereof, first pivot pins connecting the lower swivel plate to the bifurcated arm, and second pivot pins extending between said bracket means and the upper swivel plate, said first pivot pins being positioned normal to said second pivot pins, whereby the cutter means is freely pivoted to the bifurcated arm about orthogonal axes.

4. A mobile machine according to claim 3, wherein the releasable lock means comprises, wedge means operatively connected to said pivot pins and adapted to frictionally engage said pins to thereby hold the cutter means in the vertical orientation.

5. A mobile machine according to claim 3, wherein the cutting cylinder includes a rod having one end fixedly connected to an end wall of said cylinder and the other end detachably connected to the end of the motor drive shaft.

6. A mobile machine according to claim 5, wherein the cutting cylinder is provided with a soil plug ejecting mechanism comprising, a disc plate slidably mounted in said cutting cylinder, tie rods extending through said cylinder end wall, a collar slidably mounted on said rod, one end of said tie rods being secured to said disc plate, the opposite ends of said tie rods being connected to said collar, a lever pivotally connected to said rod, and a connecting rod connected between said lever and said collar, whereby pivotal movement of said lever in one direction causes the disc plate to move toward the open cutting end of said cylinder, to thereby eject a soil plug therefrom.

7. A mobile machine according to claim 6, wherein a handle is detachably connected to one end of said lever, and a hook provided on one end of said handle to facilitate removing a cup from the hole on the putting green.

8. A mobile machine according to claim 2, wherein a depth gauge is operatively connected between the frame assembly and the carriage means for indicating the depth of the hole being cut.

9. A mobile machine according to claim 3, wherein said power means, lock means and motor means comprise hydraulic motors.

10. A mobile machine according to claim 9, wherein said power means comprises a hydraulic cylinder connected to the frame assembly, and a piston rod slidably mounted in said cylinder and having its free end connected to said carriage means.

11. A mobile machine according to claim 10, wherein said lock means comprises a hydraulic cylinder operatively connected to each swivel plate in proximity to a respective pivot pin, a plunger slidably mounted in said cylinder, a wedge member connected to the free end of said plunger and adapted to frictionally engage a respective pin.

12. A mobile machine according to claim 10, wherein the motor means comprises a rotary motor for driving the cutting cylinder.

13. A mobile machine according to claim 9, wherein said power means, lock means and motor means are hydraulically actuated through a hydraulic circuit connected to a hydraulic drive system in the motor driven vehicle, said hydraulic circuit including diverter valves interposed the hydraulic drive system and hydraulic circuit, and selector valves for controlling the actuation of the power means, lock means and motor means.

* * * * *